US005713527A

United States Patent [19]

Hemesath et al.

[11] Patent Number: 5,713,527

[45] Date of Patent: Feb. 3, 1998

[54] IMPACT CRUSHER WITH HYDRAULIC ADJUSTMENT OF THE CRUSHING GAP WHICH DETERMINES THE DEGREE OF COMMUNICATION

[75] Inventors: Gerhard Hemesath, Havixbeck; Dieter Dasbeck, Senden, both of Germany

[73] Assignee: Noell Service und Maschinentechnik GmbH, Langenhagen, Germany

[21] Appl. No.: 557,739

[22] Filed: Nov. 13, 1995

[30] Foreign Application Priority Data

Nov. 10, 1994 [DE] Germany ..... 44 40 076.4

[51] Int. Cl.[6] ..... B02C 13/09; B02C 13/26

[52] U.S. Cl. ..... 241/189.1; 241/287; 241/288; 241/289

[58] Field of Search ..... 241/32, 37, 37.5, 241/189.1, 286, 287, 288, 290

[56] References Cited

U.S. PATENT DOCUMENTS

| | | | |
|---|---|---|---|
| 2,411,302 | 11/1946 | Stine et al. | 241/187 X |
| 2,889,119 | 6/1959 | Andreas | 241/287 X |
| 2,891,734 | 6/1959 | Andreas | 241/289 X |
| 4,017,035 | 4/1977 | Stuttmann | 241/289 X |
| 4,729,517 | 3/1988 | Krokor et al. | 241/289 X |
| 5,226,604 | 7/1993 | Seiffert et al. | 241/30 |
| 5,255,869 | 10/1993 | Smith | 241/189.1 |
| 5,513,811 | 5/1996 | Phan Hung | 241/189.1 |

FOREIGN PATENT DOCUMENTS

| | | |
|---|---|---|
| 3525101 | 1/1987 | Germany . |
| 4116134 | 11/1992 | Germany . |

OTHER PUBLICATIONS

HAZEMAG–Prallmuehle AP–PH 1313, pp. 6 and 41 (No Date Given).

*Primary Examiner*—John M. Husar
*Attorney, Agent, or Firm*—Michael J. Striker

[57] ABSTRACT

The invention concerns an impact crusher 1 with a rotor 3 equipped with blow bars 4 and pivotably-mounted impact aprons 5, 6 arranged in the crusher housing 2, the impact aprons are positionable vis à vis the rotor by means of hydraulic cylinder-piston units 7 via piston rods 8. In a prior art impact crusher, additional mechanical devices are provided locally alongside the hydraulic retaining and positioning device 7, 9 to prevent the impact aprons 5 dropping into the tip circle circumscribed by the blow bars 4 of the rotors 3 in case of failure of the hydraulics. The invention provides additional devices connected to the corresponding hydraulically-actuatable retaining and positioning device 7, 9, using the latter's piston reds 8 to form homogeneous units 12. The additional devices include a longitudinally movable, but fixable, sleeve (17) mounted in the crusher housing (2) enclosing each piston rod (8), a clamp (18) for fixing the sleeve (17) in the crusher housing (2) and a portion of the piston rod (8) formed to engage and limit motion of the piston rod (8) in it.

9 Claims, 2 Drawing Sheets

IMPACT CRUSHER WITH HYDRAULIC ADJUSTMENT OF THE CRUSHING GAP WHICH DETERMINES THE DEGREE OF COMMUNICATION

BACKGROUND OF THE INVENTION

The invention concerns an impact crusher with a rotor provided with blow bars and with pivotable impact aprons disposed in the crusher housing which by means of hydraulic cylinder-piston units are adjustably positionable relative to the rotor via piston rods.

The trend in the development of such crushing machines is directed towards control from a control desk located at a distance from the machines of the operationally required adjustments of the impact aprons which are decisive for the degree of comminution. The control is preferably effected by means of hydraulic actuating devices.

Such hydraulic devices can, however, fail, for instance as a result of leaks in the hydraulic lines. During adjustment of the impact aprons of impact crushers, for example by hydraulic cylinder-piston units, these failures can lead to extensive damage, since, as a result of their own weight, the impact aprons can then drop into the tip circle circumscribed by the blow bars of the rotor.

For this reason, impact crushing machines, such as impact crushers or impactors, the impact aprons of which are adjustably supported vis à vis the rotor by means of hydraulic cylinder-piston units via piston rods, are provided with additional devices which are mechanically connected to the impact aprons and which by means of adjustable stops prevent the impact aprons dropping into the tip circle circumscribed by the blow bars of the rotor, should the hydraulic retaining and positioning means fail.

In the case of prior art impact crushers, these additional mechanical devices are arranged independently of the hydraulic retaining and positioning means, as a result of which the impact crusher design becomes more complicated and expensive (see HAZEMAG Operating Instructions, Impactor AP-PH 1313, Pages 6 and 41). There is also a known impact crusher as specified in DE 35 25 101 A1, the hydraulic retaining and positioning means of which is equipped with additional, resiliently acting damping elements and featuring a stop which limits the movement of the damping elements and thus the movement of the impact apron connected via link rod towards the rotor. The stop is made up of nut-type parts which are screwed onto the piston rod of the damping cylinder on the side of the retaining and positioning means furthest away from the impact apron, and which are braced against the cylinder of the retaining and positioning means in appropriate circumstances.

The prior art design is overall very complicated and thus expensive, moreover an adjustment of the stop and thus an alteration of the lowering depth of the impact apron towards the rotor is hardly or only with great difficulty possible, at any rate not within the sense of remote actuation.

SUMMARY OF THE INVENTION

It is an object of the present invention to provide an impact crusher of the above-described type including additional devices connected to its impact aprons, which by means of adjustable stops prevent the impact aprons from dropping into the rotor if the hydraulic fail, and which is less complicated and less expensive than those of the prior art.

It is another object of the present invention to provide a way of converting at reasonable cost conventional impact crushers with mechanical spindle adjustment to hydraulic adjustment of the impact aprons with a gap measuring and monitoring device.

It is an object of a further additional embodiment of the present invention to provide an impact crusher of the above-described type including devices for adjusting the impact aprons including means for adjusting the stop depth of the impact aprons by remote control.

This is effected according to the invention in that the piston rod connected to the impact apron which is moveable with the assistance of the hydraulic cylinder-piston unit is enclosed longitudinally movable in a sleeve, which is in turn longitudinally movable and fixable in the crusher housing and which serves as a stop for a part of the piston rod provided on the section of the piston rod furthest away from the impact apron in case of a movement towards the rotor.

Such a design permits the stop to be adjusted and to come into effect, even when, with worn blow bars, a smaller crushing gap is called for and the impact apron has to be adjusted towards the rotor beyond the original tip circle circumscribed by new blow bars.

Indeed, DE 41 16 134 A1 reveals an impact crusher with hydraulic gap setting devices, featuring a synchronizing cylinder with a double-ended a piston rod, whereby the piston rod end facing away from the impact apron is provided with a hydro-mechanical clamping device. This clamping device, also described as a safety clamping device, is provided solely for the purpose of sealing the piston rod and thus the impact apron in the rest position and to prevent any unwanted shift. However, this also prevents the impact apron in the event of overloading from being able to retract against the hydraulic pressure limited, for example, by pressure relief valves. Free longitudinal movement of the piston rod is not established.

If, according to a further embodiment of the device, the sleeve encloses a part of the piston rod having a reduced diameter, the result is a simple yet technically extremely good interaction between the annular face pointing towards the impact apron of that section of the piston rod of greater diameter furthest away from the impact apron and the end face of the sleeve facing away from the impact apron, which acts as a stop to limit the movement of the piston rod and thus the impact apron in the direction of the rotor in such a way that the impact apron cannot encroach into the tip circle circumscribed by the blow bars of the rotor.

The positioning of the sleeve in the required location in the crusher housing is effected in any suitable manner following the release of a clamp gripping the sleeve, which clamp is firmly disposed on the crusher housing in the direction of movement of the piston rod. This operation is carried out with the rotor at rest, so that the actual gap between the outer edges of the blow bars and the edges of the impact apron projecting furthest towards the rotor can be measured through an open housing door.

In an advantageous manner, the positioning of the sleeve is effected by hydraulic movement of the piston rod. For this purpose, the piston rod is provided at the section between the sleeve and the impact apron with a carrier which, after release of the sleeve clamp, takes the sleeve away from the rotor when the piston rod is moved.

When the sleeve is being positioned, it is first of all lifted by the carrier and then moved downwards by means of the aforementioned annular face of the piston rod until there remains a small safety gap between the impact apron and the blow bars, which can be observed when the rotor is at a standstill and the housing door is open.

The clamp which fixes the sleeve is advantageously equipped with a hydraulic actuating device, so that it can be actuated from a remote control desk.

The hydraulic retaining and positioning means is provided in the known manner with a gap measuring device, through which the movement of the piston rod can be displayed on a digital indicating instrument. Since the initial position in which the gap is more or less zero varies as a result of the operationally-contingent wear of the blow bars and the impact aprons as a result of the re-adjustment of the impact aprons with different impact apron positions, in order to receive correct gap setting data at the indicating instrument, the gap measuring device must also be adjusted correspondingly when the sleeve is positioned anew. To do this according to the invention, provided laterally adjacent to the piston rod is an inductively-acting limit switch which is adjustable in the direction of movement of the piston rod, the limit switch interacting with a special part of the piston rod and which during the said interaction effects the zero position on the indicating instrument of the gap measuring device connected to the piston rod, thus permitting adjustment of the gap between impact apron and tip circle circumscribed by the blow bars of the rotor from a control desk located at a distance from the site of the impact crusher. The special part of the piston rod is formed by the shoulder resulting from the reduction in the diameter of the piston rod. The change of mass at this point is sensed by the inductively-acting limit switch as a measuring threshold value.

It is particularly advantageous for the limit switch to be arranged on a pivotable rocker, on which a spindle acts with the aid of an adjusting device. The adjusting device according to the invention comprises a hydraulic cylinder-piston unit or a linear-acting electromotor-driven element.

With such units, the possibility of converting older impact crashers to hydraulic actuation is particularly easy, since they can be pre-assembled in the works.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENTS

Figure 1:
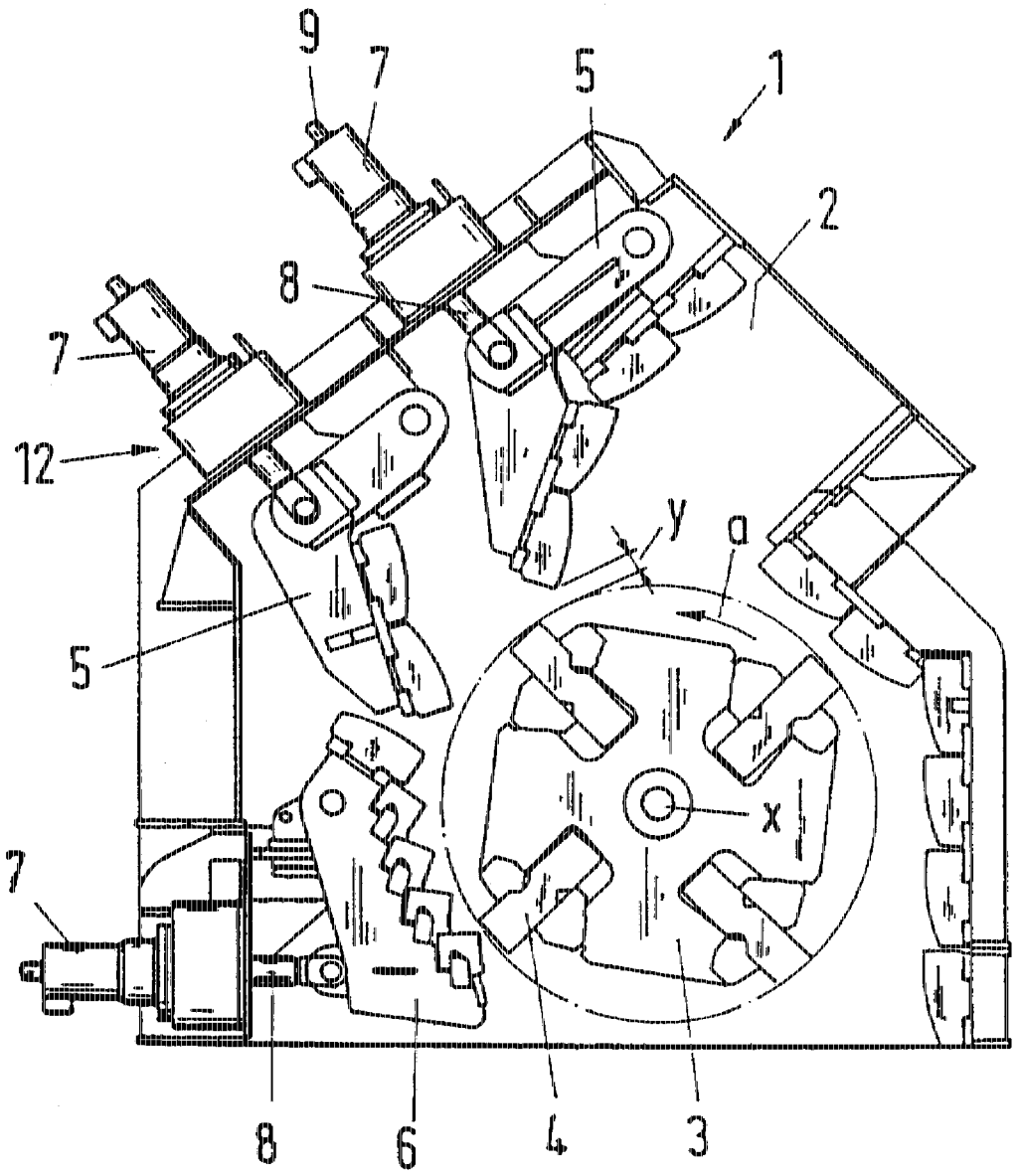
FIG. 1 is a cross-sectional view of an embodiment of an impact crusher according to the invention.

The impact crasher in FIG. 1 is identified by the number 1. It features a crusher housing 2, in which a rotor 3 rotates around axis x in the direction of the arrow a. The rotor is equipped with blow bars 4. In the crusher housing are furthermore two impact aprons 5 and a corresponding grinding face 6. There is a gap 4 between the tip circle circumscribed by the blow bars and the lower edge of the impact aprons and grinding face respectively. Impact aprons and grinding path are each provided with a hydraulic cylinder-piston unit 7, the piston rod 8 of which is connected to the associated impact apron 5 or grinding face 6. The hydraulic cylinder-piston units are provided with known gap measuring devices 9 and together with the additional devices 10 and additional positioning means 11 visible in FIG. 2 each form a homogeneous unit 12.

Figure 2:
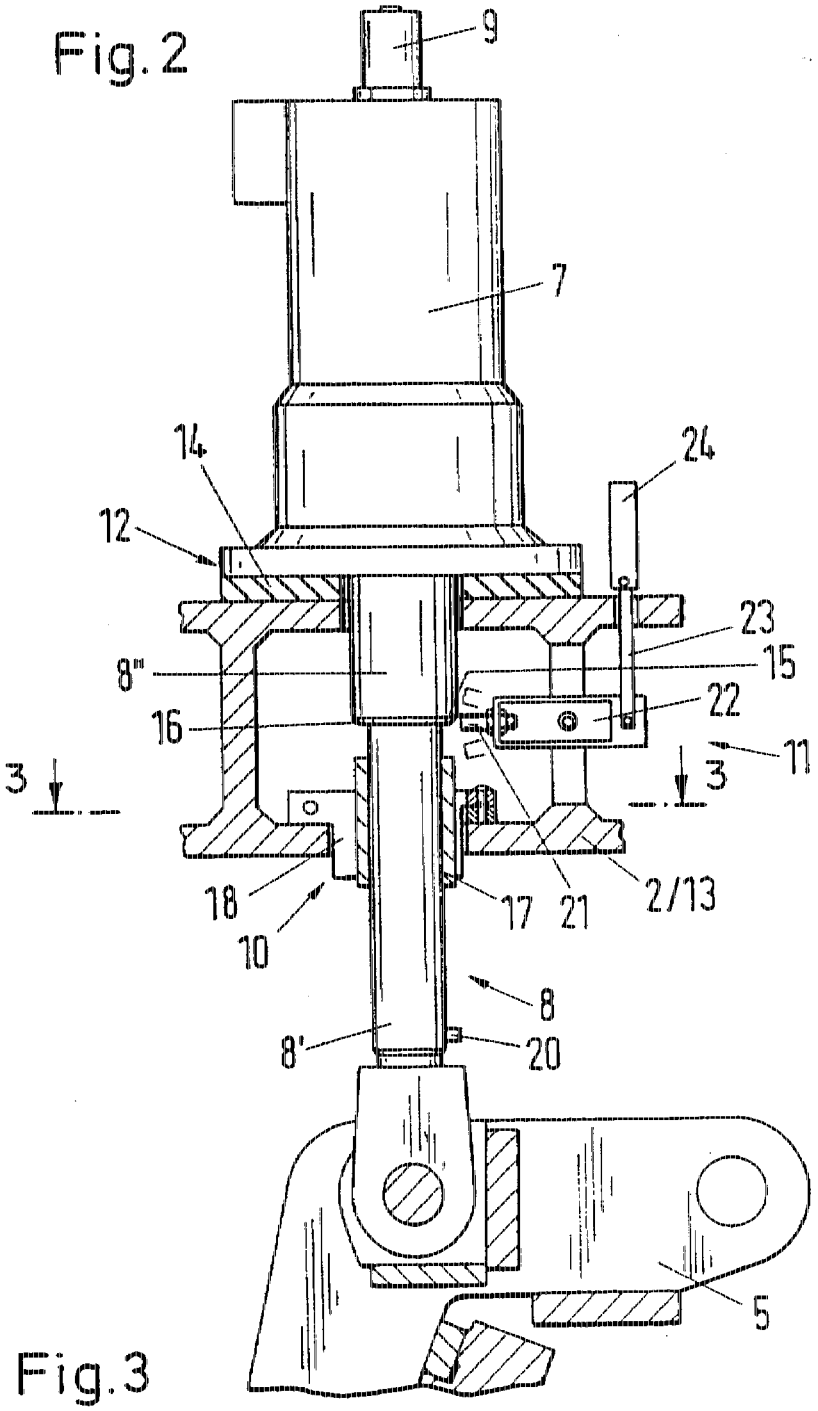
FIG. 2 is a detailed partially plan, partially sectional view of a hydraulically-actuable retaining and positioning means taken from the impact crusher of FIG. 1.
Figure 3:
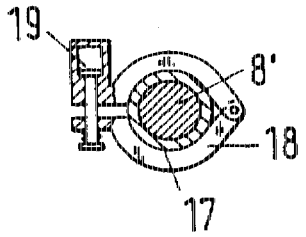
FIG. 3 is a cross-sectional view taken through the retaining and positioning means of FIG. 2 along the section line A—A in FIG. 2.

As can be seen in FIG. 2, a part of the crusher housing 2 can be designed as a hollow frame 13 or similar. Affixed to the hollow frame using a levelling plate 14 is the cylinder-piston unit 7. The piston rod 8 comprises a reduced diameter part 8' and a thicker diameter part 8". The place where beth parts meet is designated as special part of the piston rod and bears the identification number 15. The number 16 represents an annular face which originates from the reduced diameter part 8' and the thicker diameter part 8" and which faces towards the impact apron from the latter part—the section of the piston rod furthest away from the impact apron 5 and grinding face 6 respectively.

The additional devices 10 comprise a sleeve 17 slidably enclosing the thinner part 8' of the piston and a clamp 18 encompassing this sleeve. The clamp is arranged on the crusher housing 2 or on hollow frame 13 so as to be fixed in the direction of movement of the piston rod 8, possibly featuring roughness on the inner surface facing towards the sleeve 17, which roughness is in contact with corresponding roughness on the outer surface of the sleeve.

The clamp 18 is actuated by means of a hydraulic device 19, for instance a cylinder piston unit. The piston rod 8 has a carrier 20 on its lower end facing towards the impact apron 5.

Approximately in line with the special part 15 of the piston rod 8 is an inductively-acting limit switch 21 mounted on a rocker 22, which is pivotably mounted on the crusher housing 2 or the hollow frame 13 in such a way that the limit switch can be swivelled in the direction of movement of the piston rod 8. On the end of the rocker 22 opposite to the limit switch is provided a spindle or rod 23, which can be moved in a longitudinal direction by an adjusting device 224. The adjusting device can be a manually-adjusted nut; a hydraulically-actuated cylinder-piston unit or a linear-acting electromotor element can also be used. Part nos. 15 and 21–24 are also grouped together under the designation of positioning means 11.

To determine the gap y between the lower edge of an impact apron 5 and the tip circle of the rotor 3, first of all the clamp 18 is released and by means of the annular face 16 of the piston rod 8 through movement of the same towards the rotor, the sleeve 17 is moved in that direction until the lower edge of the impact apron just fails to touch one of the blow bars 4 when the rotor is at a standstill, a safety gap being maintained. Then, the clamp 18 is closed using hydraulic actuating device 19, thus firmly clamping the sleeve 17 in position, which as a consequence of the firm disposal of the clamp 18 in the direction of movement of the piston rod 8 is now fixed.

With the aid of the hydraulic cylinder-piston unit 7, the piston rod 8 is advanced, thus moving the impact apron 5 affixed thereto in the direction of rotor 3, during which operation the gap measuring device 9 relays to an indicator (not illustrated) the distance travelled and thus the gap y, applying conversion factors.

If, for any reason, the hydraulic cylinder-piston unit fails, perhaps through leaks or fractures in the hydraulic lines, the impact apron 5 can only drop so far towards the tip circle of the rotor 3 until the annular face 16 comes to a stop against the fixed sleeve 17.

It is not difficult to see that, after recomputation over the various lever lengths, the gap y corresponds to the value appearing between fixed sleeve 17 and annular face 16.

The inductively acting limit switch 21 detects the change of mass at the transition point between the reduced diameter part 8' and the thicker diameter part 8" of the piston rod in the form of a threshold value and sends an appropriate signal to the electrical indicating device or an appropriate control device, the latter bringing about the cessation of movement of the piston rod 8 on reaching the threshold value, which is at the same time the desired gap width.

As a result of wear to the blow bars 4 and the edges of the impact apron 5 or grinding path 6 facing the blow bars, the gap y increases. Also, sometimes a different product granulometry may be desired, so that the gap which determines the product size must be changed. In order to achieve this, the limit switch 21, which is disposed for this purpose on the rocker 22, is adjusted in the longitudinal direction of the piston rod 8. The adjustment can be effected remotely, if an adjusting device 24 comprising, for instance, a hydraulically actuatable cylinder-piston unit, acts on the spindle 23. In this case, uniting the measuring values from the gap measuring device 9 and the values of the adjusting device 24 in a control unit are advantageous.

In cases of advanced wear to the blow bars and impact apron edges, re-adjustment of each sleeve can be necessary from time to time. To do this (the rotor must be at a standstill), the clamp 18 is released and the piston rod 8 and thus the impact apron 5 advanced towards the rotor until the above-mentioned safety distance is reached, through which the sleeve 17 is also adjusted in the appropriate direction and then again to be fixed in position by locking the clamp 18.

If totally worn blow bars are replaced by new blow bars, the sleeve 17 of each unit must be returned to its initial position. To do this, the clamp 18 is released and the piston rod 8 advanced so that the carrier 20 disposed on the end nearest to the impact apron withdraws the sleeve away from rotor 3, in order to permit re-alignment in the reverse direction to that described previously.

The invention is not limited to impact crushers. It can also be applied to hammer crushers or hammer mills, when these feature adjustable secondary crashing implements.

We claim:

1. An impact crusher comprising a crusher housing (2);

a rotor (3) equipped with blow bars (4) arranged in the crusher housing;

impact aprons (5) pivotably mounted in the crusher housing so as to be movable to and from said rotor;

hydraulic retaining and positioning means for adjusting and maintaining a position of each of the impact aprons relative to the rotor, said hydraulic retaining and positioning means comprising a hydraulic cylinder-piston unit (7) for each of said impact aprons, said hydraulic cylinder-piston unit including a piston rod (8) connected to a respective one of said impact aprons;

means (10) for preventing said impact aprons (5) from dropping into a tip circle circumscribed by said blow bars (4) of said rotor when said hydraulic retaining and positioning means fails, said means for preventing comprising additional devices mechanically connected to the impact aprons and the hydraulic retaining and positioning means via said piston rods;

wherein said additional devices each comprise stop means for preventing further motion of a respective one of said piston rods toward said rotor, said stop means including a longitudinally movable, but fixable with respect to a direction of movement toward said rotor, sleeve (17) mounted in said crusher housing (2) and enclosing each of said piston rods (8) so that said piston rods are movable toward said rotor, means (18) for fixing said sleeve (17) in said crusher housing (2) to prevent longitudinal movement of said sleeve (17) toward said rotor and a portion of the piston rod (8) furthest from said impact apron formed to engage said sleeve (17) so that, when said sleeve is fixed in said crusher housing (2) by said means (18) for fixing said sleeve, said portion is engageable on said sleeve (17) to stop motion of said piston rod (8) and said impact apron toward said rotor.

2. The impact crusher as defined in claim 1, wherein said piston rod (8) comprises a reduced diameter section (8') comparatively close to said impact apron (5) and a thicker diameter section (8") comparatively far from the impact apron (5) and said portion of said piston rod (8) comprises an annular face (16) facing said impact apron (5) and extending between said reduced diameter section (8') and said thicker diameter section (8").

3. The impact crusher as defined in claim 1, wherein said means (18) for fixing said sleeve comprises a clamp encompassing said sleeve (17), said clamp being mounted in said crusher housing (2) so as to be fixed in said direction of motion toward said rotor.

4. The impact crusher as defined in claim 3, wherein said means (18) for fixing said sleeve comprises a hydraulic actuating device (19) connected to said clamp for opening and closing said clamp.

5. The impact crusher as defined in claim 1, wherein said additional devices include means for withdrawing said sleeve (17) from said rotor (3) when said sleeve is not fixed in position in said crusher housing (2), and said means for withdrawing said sleeve comprises a carrier (20) on each of the piston rods (8) between the impact apron (5) connected to said piston rod (8) and said sleeve (17).

6. The impact crusher as defined in claim 1, further comprising means for measuring a gap width between the impact apron (5) and the tip circle circumscribed by the blow bars (4) of the rotor (3), said means for measuring the gap comprising a gap measuring device (9) having a zero position and connected to the piston rod (8) and an inductive limit switch (21) laterally positioned adjacent the piston rod (5) and including means for interacting with a special portion (15) of the piston rod (8), means for adjusting a position of the limit switch (21) in said direction of motion toward said rotor and means for setting the zero position of the gap measuring device (9).

7. The impact crusher as defined in claim 6, wherein said means for adjusting the position of the limit switch includes a pivotable rocker (22) on which the limit switch (21) is mounted and an adjusting device (24) connected via a spindle (23) to the pivotable rocker (22) for pivoting the pivotable rocker (22).

8. The impact crusher as defined in claim 7, wherein the adjusting device (24) comprises an adjusting device cylinder-piston unit.

9. The impact crusher as defined in claim 7, wherein the adjusting device (24) comprises a linearly acting electromotor driven element.

* * * * *